US005983548A

United States Patent [19]

Ludaescher

[11] Patent Number: 5,983,548

[45] Date of Patent: Nov. 16, 1999

[54] NON-LETHAL FIREARM DEVICE

[75] Inventor: Edward C. Ludaescher, Oxnard, Calif.

[73] Assignee: Option Safety, LLC, Oxnard, Calif.

[21] Appl. No.: 09/023,903

[22] Filed: Feb. 13, 1998

[51] Int. Cl.[6] ..... F41C 27/06

[52] U.S. Cl. ..... 42/1.08; 42/90

[58] Field of Search ..... 89/1.2; 222/79; 42/1.08, 105, 90

[56] References Cited

U.S. PATENT DOCUMENTS

| | | | |
|---|---|---|---|
| 1,269,922 | 6/1918 | Gadecki | 222/340 |
| 1,333,268 | 3/1920 | Masiates | 42/106 |
| 2,124,172 | 7/1938 | Wildes et al. | 42/1.08 |
| 3,109,253 | 11/1963 | Eig | 42/1.09 |
| 3,298,125 | 1/1967 | Adrian et al. | 42/1.08 |
| 3,374,708 | 3/1968 | Wall | 89/1.11 |
| 3,619,930 | 11/1971 | Beermann et al. | 42/1.08 |
| 3,706,151 | 12/1972 | McNeill | 42/106 |
| 3,707,793 | 1/1973 | Holtor, II | 42/1.08 |
| 3,733,727 | 5/1973 | Jones et al. | 42/106 |
| 3,841,526 | 10/1974 | Haskins | 222/79 |
| 3,956,843 | 5/1976 | Litman | 42/105 |
| 4,058,921 | 11/1977 | Mason | 42/1.08 |
| 4,316,388 | 2/1982 | Mason et al. | 222/79 |
| 4,777,754 | 10/1988 | Reynolds, Jr. | 42/103 |
| 5,088,624 | 2/1992 | Hackett et al. | 222/78 |
| 5,225,623 | 7/1993 | Krasnow | 89/1.1 |
| 5,397,029 | 3/1995 | West | 222/79 |
| 5,473,501 | 12/1995 | Claypool | 42/1.08 |
| 5,485,695 | 1/1996 | Glock | 42/103 |
| 5,581,898 | 12/1996 | Thummel | 42/103 |
| 5,671,559 | 9/1997 | Ludaesher et al. | 42/1.08 |
| 5,787,628 | 8/1998 | Teetzel | 222/79 |

FOREIGN PATENT DOCUMENTS 118813 9/1918 United Kingdom .

*Primary Examiner*—Stephen M. Johnson
*Attorney, Agent, or Firm*—Kelly Bauersfeld Lowry & Kelley, LLP.

[57] ABSTRACT

A combination lethal/non-lethal firearm device is disclosed wherein a lethal gun, pistol or rifle that conventionally fires solid projectiles in the form of bullets, is converted to a non-lethal defensive weapon by means of a novel canister unit attachment which will deploy a non lethal chemical fluid such as tear gas or pepper gas. The novel non-lethal apparatus uncomplicated in construction and is adapted for easy use and inexpensive maintenance. The non-lethal apparatus has a top portion which is removably attached to the underside of the barrel, and a rear mounting portion attached to a trigger guard of a firearm. The direction of fire of the fluid propellant therein is along the firearm barrel and in the same line of fire as the trajectory of a solid projectile bullet of the firearm. Activation of the chemical dispenser is achieved by a novel means of pressing a force application pad near the trigger guard, the force application pad being attached to a pivoting arm which communicates with an actuating button on the canister, whereby the chemical agent is propelled out of the apparatus. Because of the mechanical advantage gained by the pivoting arm, an extraordinary amount of strength is no longer necessary to deploy the non lethal propellant and a peace officer may quickly and easily choose the better of lethal or non lethal defensive procedures.

20 Claims, 7 Drawing Sheets

NON-LETHAL FIREARM DEVICE

FIELD OF INVENTION

The present invention relates to self-defense devices, specifically devices which deliver debilitating chemical agents. More specifically, the invention relates to a combination of lethal and non-lethal firearm devices that can deliver a variety of non lethal debilitating fluid propellants and chemical agents as well as, and as an immediate and easily administered alternative, conventional lethal firearm ammunition and solid propellants.

DESCRIPTION OF THE PRIOR ART

Due to the actual or perceived threat of violence in today's society, firearms are more likely to be the weapon of choice for both law enforcement personnel and the public in situations where they must arm themselves in preparation for immediate retaliation as a result of a threat of unknown force.

Today's law enforcement personnel (patrol, detectives, narcotics, SWAT, DEA, ATF, FBI and other units) are often poorly equipped to meet the threat of violence which increases daily. They need to be able to respond with a variety of offensive and defensive maneuvers and weapons that can quickly adjust to both a non threatening, non-lethal environment, and to an immediate threat of serious bodily harm or death to an officer, victim or innocent bystander.

The patrol officer's arsenal normally includes a revolver or semi-automatic pistol, a two way radio, a club, handcuffs, ammunition, flash light and chemical dispensers. The more highly trained special weapons and tactics members (SWAT) more often rely on fully-automatic pistols such as the Uzi or MP-5 instead of revolvers or pistols. However, in an effort to limit liabilities, severe restrictions are placed on their use. Officers entering hostile situations are rarely informed as to the extent of violence to be encountered until faced with it. It is unreasonable to expect a peace officer to be fully equipped to handle each situation beforehand without complete and accurate information as to the circumstances.

Consequently, law enforcement and the public confront many situations with a firearm drawn for immediate use. Only then do they realize that deadly force is not justified but nonlethal action must be taken to prevent injury, escape, and destruction of property or evidence.

When encountering these situations, peace officers may need only resort to the chemical debilitating agent which is usually strapped to their belts. However, if their hands are occupied with a firearm or a flashlight for better vision, they are unable to transition safely to another tool at their disposal. This results in the taking of unnecessary risks such as physical engagement of the individual while the officer has the firearm in the dominant hand. Other risks may include prematurely re-holstering the weapon or use of deadly force. With the advent and acceptance of two-handed grips, law enforcement is reluctant to remove one hand from the firearm to reach for the chemical spray on his belt or entry vest. Moreover, the user must continuously maintain a sight picture of the target in order to react immediately should the threat escalate. Additionally, an officer's other hand may be necessarily occupied manipulating doors or moving articles during searches.

The present invention is a device which will eliminate the need to remove one hand from the lethal weapon in order to deliver a chemical debilitating agent. The present invention is a device which is to be utilized in conjunction with a firearm. It will create an easily dispensable method for delivering a chemical debilitating agent in the direction of the barrel while maintaining both hands on the firearm. In addition, it is a simple device that can be easily and inexpensively replaced or repaired.

This improvement of a non-lethal attachment for a lethal weapon satisfies a desperate need of law enforcement and the public. It provides an option which, when utilized, will de-escalate certain situations. A primary example of one of these situations is one in which the user has a firearm drawn, physical engagement is to be avoided and deadly force is not yet justified. However, the situation is such that less than lethal force must be taken while the option of deadly force is maintained. For the non-lethal force attachment to function in such a situation, it must be easily and quickly dispensable by police officers regardless of varying hand strength.

In order to accomplish this the present invention is a device which can be an attachment to or a part of a firearm, such as a standard revolver, semi-automatic or fully automatic pistol, or shotgun. This invention enables a person to dispense a debilitating chemical agent in a direction parallel to the barrel of the firearm with little or no modification to the firearm. The debilitating chemical is dispensed by pressing a lever that significantly reduces the amount of force necessary to administer the non-lethal force. This attachment has little or no effect as to the function or operation of the firearm.

The present invention will allow the average user to quickly and efficiently take less than lethal action with a drawn firearm while still evaluating the situation. When the user is confronted with a person the user believes is armed or one who is armed with a weapon other than a firearm, the user can immediately disable the threat. The user does this by utilizing less than lethal force while never relinquishing the ability to use the lethal force of the firearm if necessary.

Prior to 1977, tear gas and other chemical debilitating agents were developed and well utilized. Eventually combination devices were invented. For example, Wildes et al., U.S. Pat. No. 3,124,172 discloses a tear-gas gun in combination with a policeman's billyclub. This extended the peace officer's area of intervention beyond the reach of the user. However, the device being in combination with a billyclub restricted the user to non-lethal options.

Tear gas dispensers have been described in many different applications. In U.S. Pat. No. 3,109,253 of Eig, a gas dispensing cartridge was hidden in a cigarette lighter adaptation and in U.S. Pat. No. 3,208,125 of Adrian an explosive gas dispensing cartridge was disposed in a pocket pen type device having a trigger release mechanism. Although these are clever disguises these devices are of little or no use to law enforcement personnel. Larger gun or rifle type fluid dispensing weapons have been described in U.S. Pat. No. 3,706,151 of McNeill where a shoulder mounted type rifle or gun is designed to deliver a volume of liquid or gas in a sabot, and hand or palm shaped gas dispensing devices or guns have been conceived to be covertly pocketed and hidden until needed as disclosed in U.S. Pat. No. 3,707,793 of Holtor. However, these devices only offer non-lethal options and are insufficient in life threatening situations.

Haskins, U.S. Pat. No. 3,841,526 describes a device which discharged debilitating from a pistol or hand shaped gun device. This invention, however, could be dangerous as the invention appears to be a lethal weapon to a suspect, but in fact was not. This non-lethal weapon could actually exacerbate a situation in which lethal force was not necessary. Wielding what appeared to be a firearm could provoke a lethal response from an opponent who feared the lethal looking weapons. U.S. Pat. No. 3,956,843 of Litman discloses a launch tube tear gas firing device for covering a greater distance than normally attainable, yet it fails to offer a combination lethal/non-lethal firearm.

Ultimately, in 1977, a pistol was modified to allow the user to dispense a chemical agent from the butt end of the gun. See Mason, U.S. Pat. No. 4,058,921. This was done while holding the pistol in a "safe" position with the barrel pointed up. Law enforcement of 1977, considered the barrel-up position "safe." Today, however, law enforcement practices teach that to be "safe" the barrel of a firearm must be pointed where the user is looking and in particular in the direction of a potentially armed suspect. A firearm pointed at the ceiling is no longer considered a "safe" position.

This problem was overcome with the non-lethal firearm device described in U.S. Pat. No. 5,671,559 by Ludaesher, which describes an attachment that will dispense the non-lethal chemical in the same direction that the barrel of the gun is aimed. This provided officers/users the ability to choose the better of lethal or non-lethal force without having to change weapons and while maintaining both hands on the firearm, pointed in the direction of the suspect. However, the described device proved very difficult to dispense since the chemical trigger which is pushed with the trigger finger in the gun required a great deal of force to activate. In addition, the described device was very complex and included a myriad of small parts that made practical use burdensome and expensive. Repair and replacement of the chemical dispenser was timely and difficult.

Much research and review of both critical incidents and officer involved shootings has been conducted over the last decade. Modem law enforcement now dictates that Peace Officers involved in high risk entries or other situations involving drawn firearms, continuously aim their weapon at the target. This is done while looking over the barrel to maintain a "sight picture" of the subject.

While the firearm is continuously pointed at the target, the peace officer is instructed to hold the firearm so that the trigger finger remains outside of the trigger guard. This reduces the possibility of accidental discharge due to involuntary reactions. The trigger finger adjacent to the trigger still allows immediate reaction to an increased threat, should it appear.

The trigger finger positioned outside of the trigger guard is the key to this invention. If the target subject does not escalate the threat with a firearm of his own the user can take immediate non-lethal action. The user can act if the target still refuses to submit to the user's directions. The user can readily dispense the chemical debilitating agent without relinquishing a two-handed grip on the weapon or spend valuable time fumbling for a non-lethal weapon during an agitated state of confrontation. These non-lethal weapons available to peace officers are normally mounted on the utility belt and dictate some delay in their utilization due to the fact they are usually not already in hand.

What is needed, therefore, and supplied by this invention, is a practical means of deescalating tactical situations not warranting lethal force. The average user can easily and efficiently resort to dispensing a chemical agent in these situations while maintaining the preferred two-handed pistol grip and a sight picture of the target. In addition, this invention provides an improved device construction that is stronger, simpler and more economical to put into wide use.

SUMMARY OF THE INVENTION

The present invention overcomes and eliminates the deficiencies of the prior art. The present invention has a housing unit into which a canister of debilitating chemical is inserted, and maintained therein by attachment of a removable cap. The housing unit is attached to a barrel of a firearm via a seat portion, wherein the seat portion is attached an upper side of the housing unit. A rear side of the housing unit has a mounting arm thereon, and the mounting arm removably attaches to a trigger guard portion of a firearm. The aforementioned attachment configurations maintain said housing unit in substantial parallel alignment with the barrel of a firearm.

A lever having at least a force application pad on one end rests near the trigger guard of the firearm. The other end of the lever is in communication with the canister and supplies the actuating force needed to release the pressurized chemical agent maintained therein. Application of force to the force pad pushes the lever forward, in turn imparting forward force on the canister, whereby an actuating button on a forward end of the canister engages an actuating ridge on the cap. The engagement of the actuating button with the actuating ridge causes release of the chemical agent through a nozzle which is in communication with the canister, whereby the chemical agent is forced out of the housing unit through an aperture on the cap.

OBJECTS AND ADVANTAGES OF THE INVENTION

The primary object of this invention is to provide a user of average hand strength, who may have to address a situation with a drawn firearm, a safe method of quickly and easily dispensing a non-lethal chemical substance. This is done by making the non-lethal chemical (Mace, tear gas, pepper spray, etc.) easy to dispense by reducing the great amount of force previously necessary to depress the actuating buttons.

Another object of the present invention is to make the non-lethal attachment device stronger and at the same time easier and more economical to repair or replace. This is achieved by creating a simple canister housing unit which incorporates several of the many components of the prior art into one molded piece.

Another general object of the present invention is to provide a dual-purpose weapon which can be deployed easily and quickly in a lethal or non-lethal manner.

A further object of this invention is to provide an attachment to, or an adaptation of, an existing firearm to provide a dual-purpose weapon suitable for a variety of tactical situations which warrant a drawn firearm.

An additional object of this invention is to provide an easily accessible device and method for a peace officer to disable a threatening subject through the use of a chemical agent such as chemical Mace, tear gas or pepper spray while continuously maintaining a sight picture of the target subject in order to react to the eventuality of an escalated threat.

The main advantage to the present invention is that a law enforcement officer so equipped, when displaying a firearm in conformance with agency's policies and procedures, will have at his immediate disposal the ability to utilize either lethal or non-lethal force.

Another advantage of the embodiments described herein is its ready adaptability to retrofit existing firearms in use today with little or no modification to the weapon.

A still further advantage of the present invention is the elimination of the multiple and detailed components necessary in the prior art.

DETAILED DESCRIPTION OF A PREFERRED EMBODIMENT

The following is a description of the best mode of implementing the concept of the invention. This description is given only to illustrate the general principles of the invention and is not to be interpreted in a limiting sense. The true scope and further extent of the invention can only be ascertained by reading the appended claims.

Figure 1:
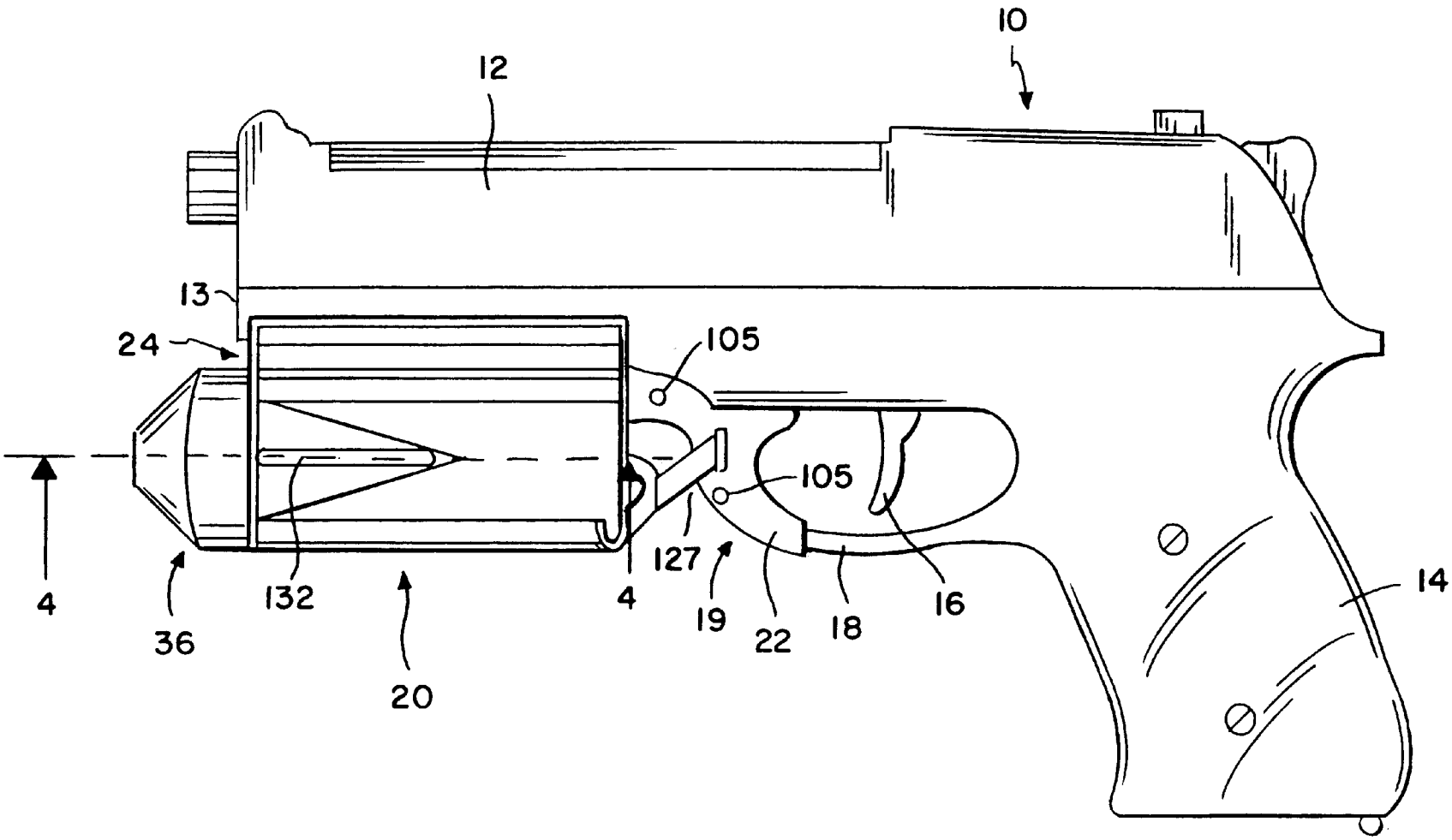
FIG. 1 is a side, elevational view of the invention concept illustrating a standard semi automatic pistol with the debilitating chemical dispensing apparatus attached thereto.
Figure 2:
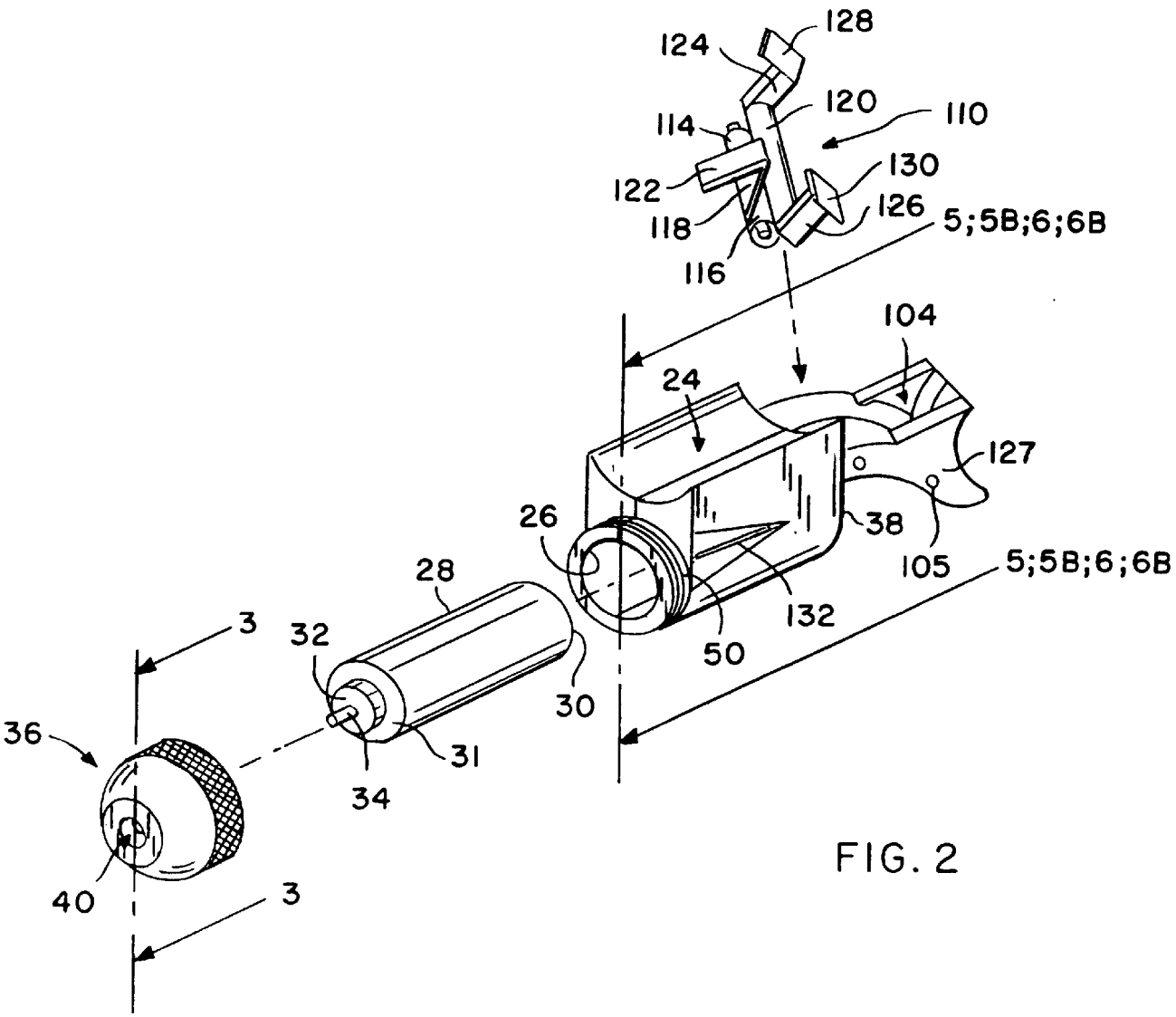
FIG. 2 is an exploded, perspective view of the non-lethal apparatus wherein the actuating lever is illustrated in a removed position.

Referring first to FIGS. 1 and 2, a lethal semi-automatic pistol 10 is illustrated with a nonlethal apparatus 20 attached thereto. Conventional pistol 10 generally includes a barrel portion 12, a handle portion 14, a trigger 16, and a trigger guard 18. Trigger guard 18 has a forward portion 19 which is retained within a rear mounting portion 22 of apparatus 20. Apparatus 20 also has a seat portion 24 which receives and removably engages a lower side 13 of barrel 12.

It will be appreciated that apparatus 20 is generally oriented in parallel alignment with barrel portion 12. Apparatus 20 has a housing unit 26 which receives a chemical dispensing canister 28 containing a debilitating chemical substance under pressure. The substance, such as pepper spray or mace, in canister 28 is mounted within housing unit 26, such that discharge of the debilitating substance will occur in parallel forward direction along the barrel 12.

Canister 28 has a distal end 30, and a proximal end 31 with an actuator button 32 located thereon. A nozzle tube 34 emanates from said actuator button 32 and is in communication with canister 28 Canister 28 is removably contained within housing unit 26 by a removably connecting cap portion 36 and a rear wall 38 of apparatus 20.

Figure 4:
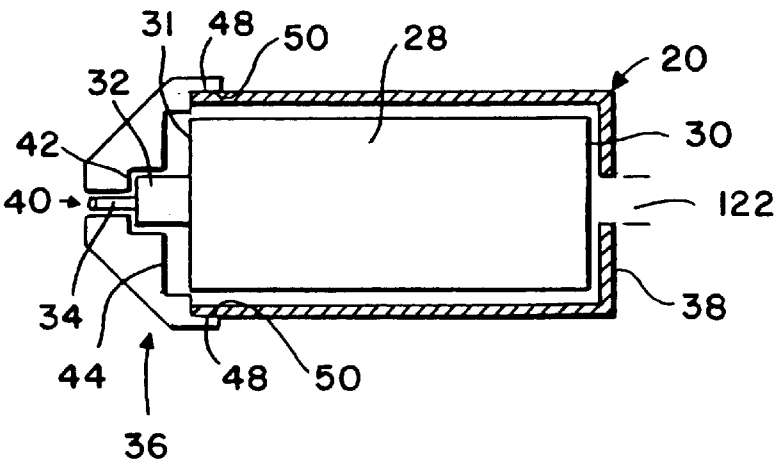
FIG. 4 is a cross-sectional view of the non-lethal apparatus taken along line 4—4 of FIG.
Figure 3:
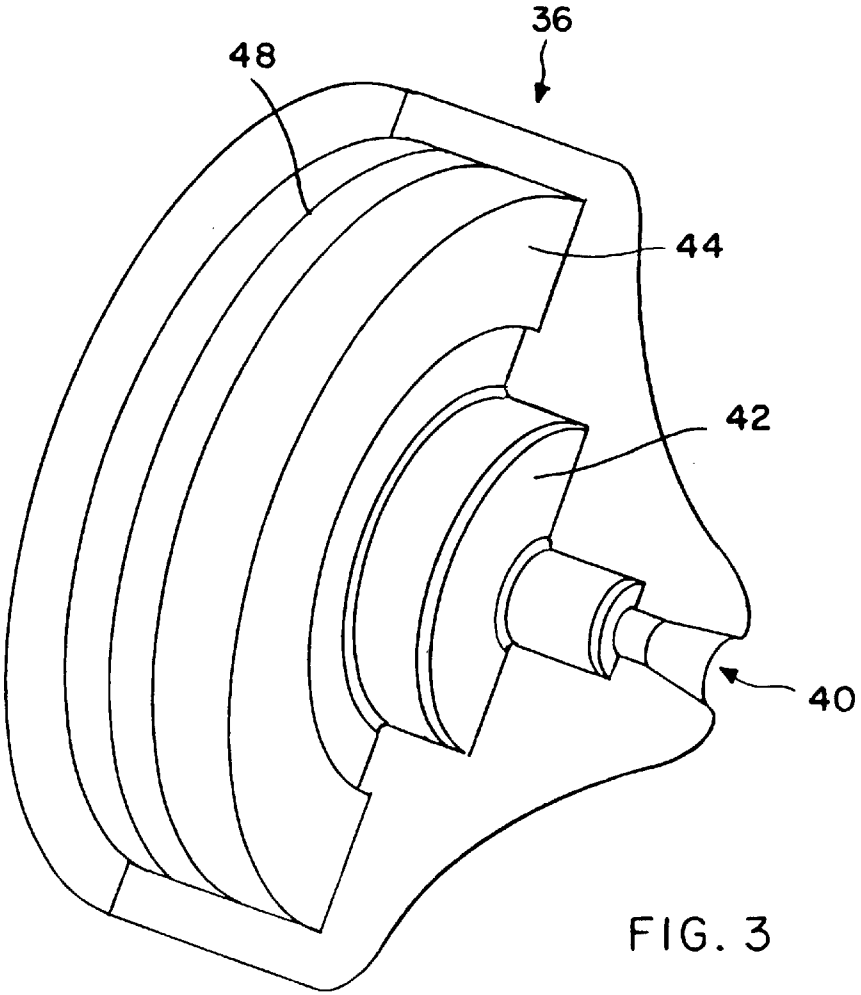
FIG. 3 is a perspective, cross-sectional view of the cap portion taken along line 3—3 of FIG. 2. 1.
Figure 5:
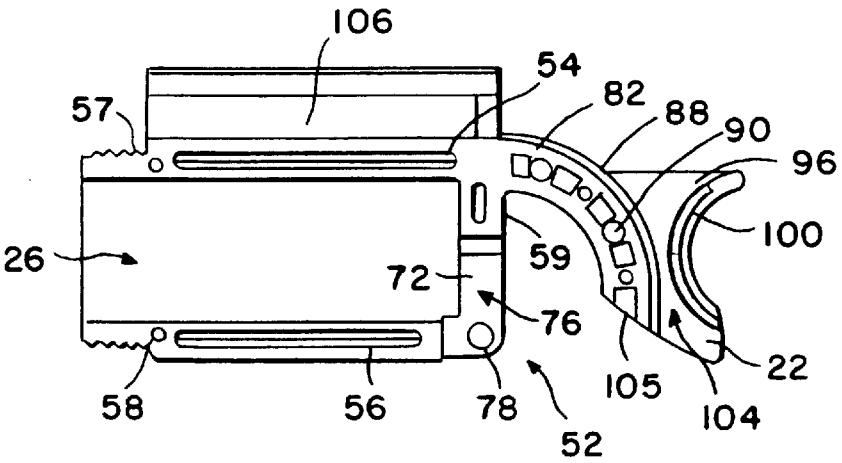
FIG. 5 is an elevational, cross-sectional view of the right side of the non-lethal apparatus taken along line 5—5 of FIG. 2.
Figure 5B:
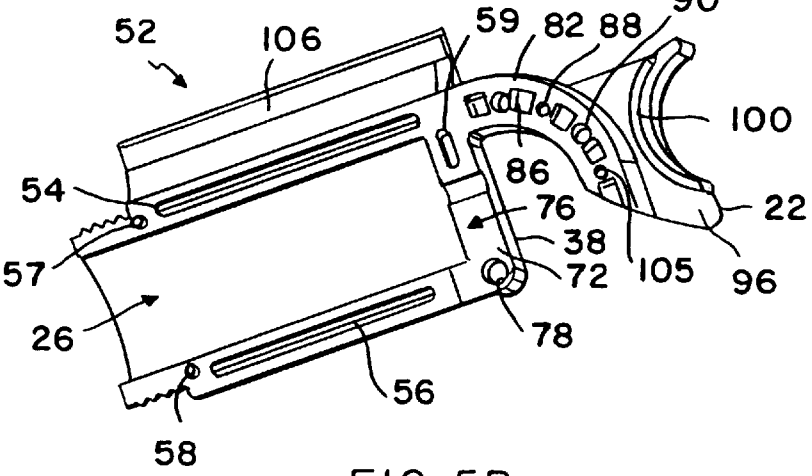
FIG. 5B is a perspective, cross-sectional view of the non-lethal apparatus taken along line 5B—5B of FIG. 2.
Figure 5A:
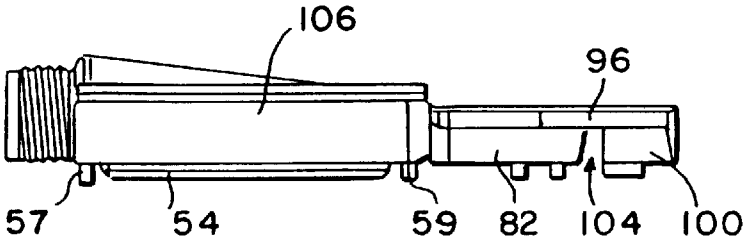
FIG. 5A is a top, plan view of the right side of the non-lethal apparatus.
Figure 6B:
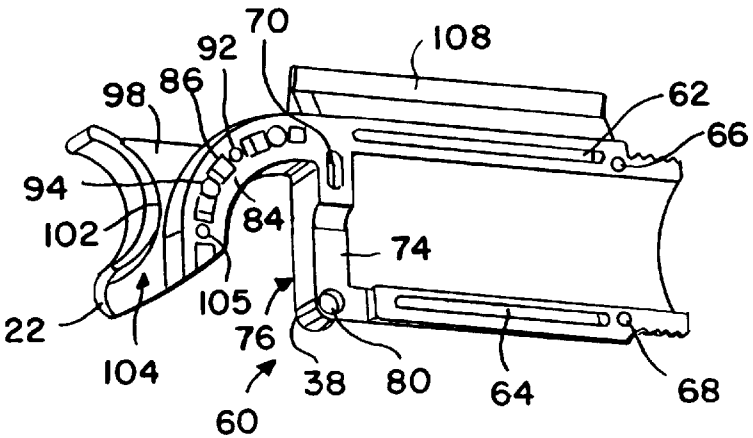
FIG. 6B is a perspective, cross-sectional view of the non-lethal apparatus taken along line 6B—6B of FIG. 2.
Figure 6:
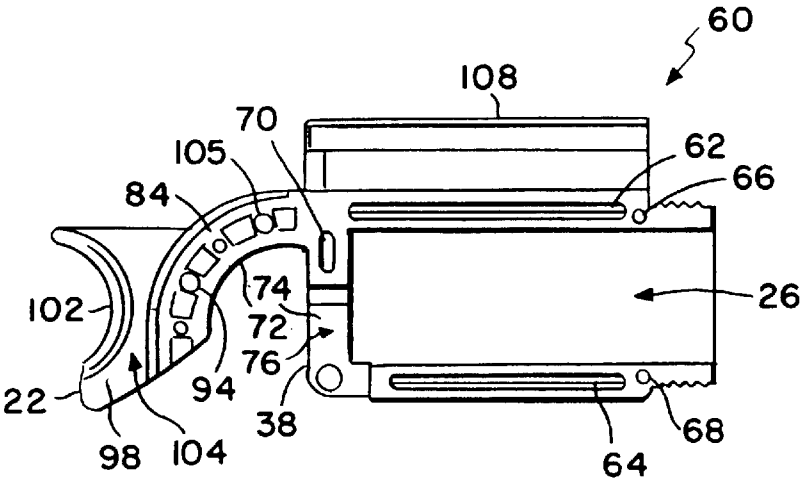
FIG. 6 is an elevational, cross-sectional view of the left side of the non-lethal apparatus taken along line 6—6 of FIG. 2.
Figure 6A:
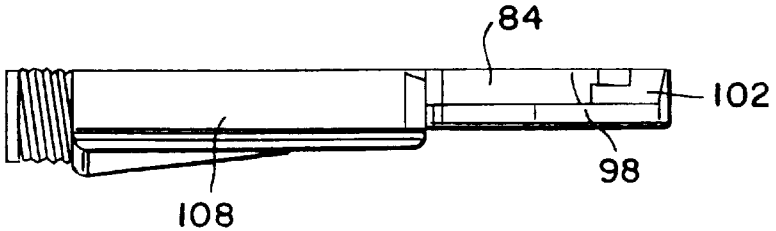
FIG. 6A is a top, plan view of the right side of the non-lethal apparatus.

Now referring to FIGS. 2, 3, and 4, cap portion 36 has an aperture 40 which receives nozzle tube 34, and an actuator ridge 42 which contacts with actuator button 32. A canister ridge 44 is located behind actuator ridge 42 and contacts proximal end 31 of canister 28. The constant communication between canister ridge 44 and proximal end 31 not only helps stabilize canister 28 within housing unit 26, but it also prevents unintentional articulation of the actuator button 32 with actuator ridge 42. Distal to and perpendicular to canister ridge 44, cap portion 36 has a threaded wall 48 which engages a threaded portion 50 on apparatus 20, thereby removably, yet securely, attaching cap portion 36 to apparatus 20.

Now referring to FIGS. 5, 5A, 5B, 6, 6A, and 6B, a right half 52 and a left half 60 of apparatus 20 is more clearly illustrated. Half 52 and 60 each forms one half of housing unit 26 and one half of rear mounting portion 22. Right half 52 has a top ridge 54 and a bottom ridge 56 which are inserted into a top cavity 62 and a bottom cavity 64, respectively, of left half 60. Right half 52 has a top protrusion 57 and a bottom protrusion 58 which are inserted into a top indentation 66 and a bottom indentation 68, respectively, of left half 60. Right half 52 has a rear prominence 59 which is received within a rear pit 70 of left half 60. The aforementioned multiple interconnections maintain both halves 52 and 60 of apparatus 20 in a stable position.

Half 52 and 60 each forms one half of rear wall 38 which abuts distal end 30 of canister 28. The rear wall 38 of both halves 52 and 60 have an inclined portion 72 and 74 respectively, whereby when both halves 52 and 60 are joined, inclined portions 72 and 74 define an orifice 76. Right inclined portion 72 has a right axial cavity 78, and left inclined portion 74 has a left axial cavity 80. Above orifice 76, rear wall 38 has attached thereto a right mounting arm 82 and a left mounting arm 84 which are curved to accommodate forward portion 19 of trigger guard 18. Both mounting arms 82 and 84 have a plurality of honey comb structures 86 to produce rigidity and strength in said arms 82 and 84. Right arm 82 has a first hump 88 and a second hump 90 which are inserted into a first bore 92 and a second bore 94 of left arm 84 respectively, to supply stability when both arms 82 and 84 are connected.

Figure 7:
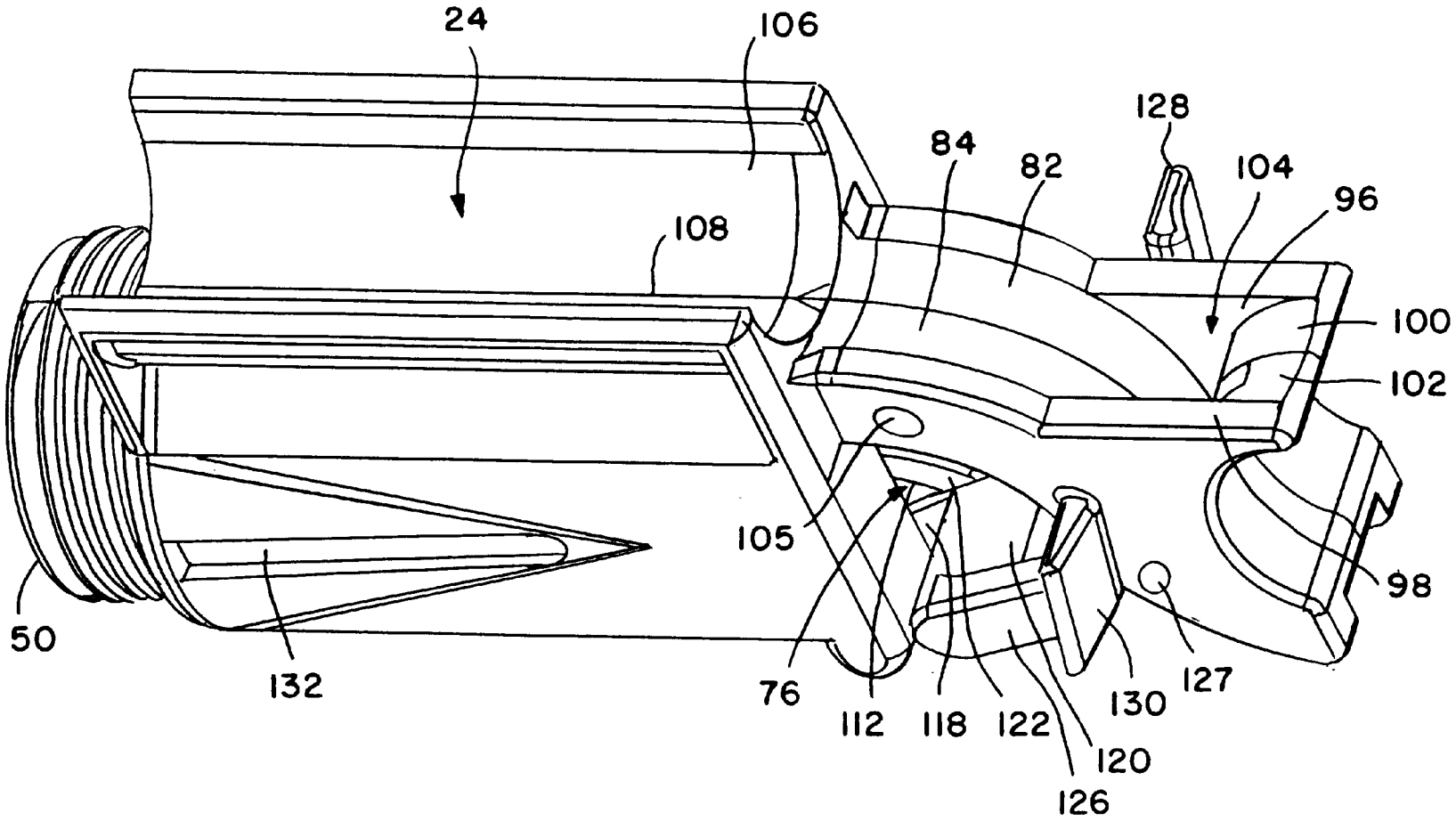
FIG. 7 is a rear perspective view of the non-ethal apparatus.
Figure 8:
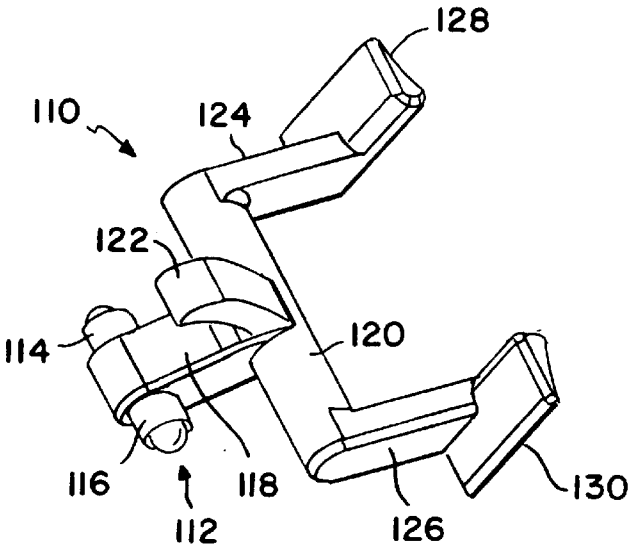
FIG. 8 is a top perspective view of the detached actuating lever.
Figure 8A:
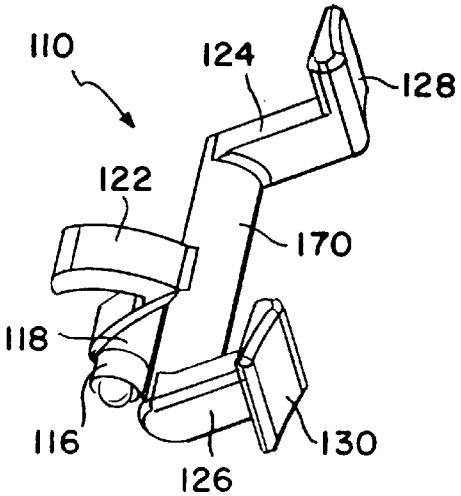
FIG. 8A is a rear perspective view of the detached actuating lever.

Now also referring to FIG. 7, in addition to FIGS. 5, 5A, 5B, 6, 6A, 6B, a right outer wall 96 extends from right arm 82 and a left outer wall 98 extends from left arm 84. Right outer wall 96 defines a right retaining wall 100 and left outer wall 98 defines a left retaining wall 102, where said retaining walls 100 and 102 are perpendicular to said respective outer walls 96 and 98. Said retaining walls 100 and 102 are also curved to accommodate forward portion 19 of trigger guard 18. Whereby, when right half 52 and left half 60 are joined, arms 82 and 84, outer walls 96 and 98, and retaining walls 100 and 102 form a chamber 104, said chamber 104 securely enclosing forward portion 19 of trigger guard 18. To firmly, yet removably, enclose trigger guard 18 within chamber 104, at least an attaching hole 105 may traverse arms 82 and 84 and be adapted to receive a binding mechanism such as a screw or a bolt.

Seat portion 24, which attaches apparatus 20 to lower side 13 of barrel portion 12, is formed by a right curved wall 106 attached to a top of right half 52 and a left curved wall 108 attached to a top of left half 60, whereby, when halves 52 and 60 are connected, a valley is formed to receive barrel portion 12.

Now referring to FIGS. 2, 7, 8, and 8A in order to decrease an amount of force needed to actuate non lethal apparatus 20, an actuating lever 110 is utilized in accordance with the physical concept of torque, wherein a lever rotating along an axis produces torque consistent with the formula $\tau$=Fd. Wherein, $\tau$ represents the torque generated at a reference axis, F represents the force applied, and d represents the distance from the axis at which the force is applied. Thereby, with a greater distance d, the force needed is decreased.

Actuating lever 110 has an axial rod 112 having a right end 114 and a left end 116, said ends 114 and 116 are received within right axial cavity 78 and left axial cavity 80 respectively, without restricting axial movement. A bar 118 perpendicularly attaches to axial rod 1 12 at one end, and bar 118 perpendicularly attaches to a boom 120 at an opposing end. A forwardly oriented curved projection 122 is attached to boom 120 and bar 118 such that projection 122 juts out of the plane of attachment of boom 120 and bar 118. Projection 122 is inserted into orifice 76 on rear wall 38 of apparatus 20 and is in contact with distal end 30 of canister 28. A right shaft 124 and a left shaft 126 attach to boom 120 at opposing ends thereof Boom 120, and shafts 124 and 126 saddle mounting arms 82 and 84 and are maintained in a firing position by at least a stopper ridge 127 on either mounting arm 82 or 84. When disengaging apparatus 20, shafts 124 and 126 may be pulled over stopper ridge 127, thus disengaging actuating lever 110.

Shafts 124 and 126 are substantially in parallel alignment with bar 118 and thereby increase the distance d in the formula $\tau$=Fd. A right force application pad 128 and a left force application pad 130 attach to shafts 124 and 126 respectively. Whereby, an application of force to either pad 128 or 130 causes forward rotation of axial rod 112, thus imparting force onto projection 122, which pushes on distal end 30 of canister 28, which in turn engages actuator button 32, thereby releasing a debilitating substance through nozzle tube 34.

Non-lethal apparatus 20 may be constructed of any substantially rigid substance such as, but not limited to, plastics, metals, or wood. Apparatus 20 may be transparent or have a viewing window 132 to determine the contents of chemical dispensing canister 28.

While the invention herein disclosed has been described by means of a specific embodiment and application thereof, numerous modifications, and variations could be made thereto by those skilled in the art without departing from the spirit and scope of the present invention. Accordingly, the scope of the invention should be determined not by the embodiments illustrated, but by the appended claims and their legal equivalents.

What is claimed is:

1. A removable firearm coupling non-lethal chemical agent dispensing apparatus, comprising:

a firearm trigger guard mounting portion with a mounting arm extending therefrom;

a housing unit attaching to said mounting arm at an opposing end to said mounting portion;

a coupling portion being attached to said housing unit and receiving a firearm barrel and firmly holding said coupling portion in substantial alignment with said firearm barrel;

a canister of chemical agent disposed within said housing unit, said canister having an actuating button and a nozzle tube in substantial alignment with said firearm barrel;

a cap portion having an aperture to receive said nozzle tube, and an actuating ridge to receive said actuating button;

an actuating lever being in communication with said actuating button, where application of force to said actuating lever produces torque along an axis to facilitate actuation of said actuating button and dispensation of said chemical agent.

2. The invention of claim 1, wherein said actuating lever is formed of at least a single unitary piece of material.

3. The invention of claim 1, wherein said actuating lever is rotationally maintained within said housing unit at a first end, and an application of force at a second end of said actuating lever produces a torque along said first end axis, thus imparting a greater force from said lever onto said canister, which in turn activates said actuating button, and release of said chemical agent is achieved with decreased force requirement at said second end.

4. The invention of claim 3, wherein said actuating lever has a curved projection in contact with a rear portion of said canister opposing said nozzle, and as a result of said curved projection, an application of force at said second end of said actuating lever is translated into a linear force along an axis substantially parallel to said nozzle, and release of said chemical agent is achieved with decreased force requirement at said second end.

5. The invention of claim 1, wherein said actuating lever is forked and straddles said mounting arm, whereby force may be applied to said lever by either a left or right handed individual.

6. The invention of claim 1, wherein said mounting arm, said housing unit, and said coupling portion are made of a single piece of material.

7. The invention of claim 1, wherein said mounting portion, mounting arm, said housing unit, and said coupling portion are made of at least two pieces of material.

8. The invention of claim 1, wherein said housing unit has a cavity located on an end opposing said cap portion, said cavity receiving a partial portion of said actuating lever to allow communication between said lever, said canister, and said actuating button.

9. The invention of claim 1, wherein components thereof are reduced to allow easier and more economical construction, use, and repair thereof.

10. The invention of claim 1, wherein said firearm trigger guard mounting portion and said mounting arm have a respective left side and a respective right side.

11. The invention of claim 10, wherein said firearm trigger guard mounting portion is created from said mounting arm by inserting an indentation in an inner portion of at least one of said sides, said indentation receiving a trigger guard after which the other side of said mounting arm encloses said trigger guard.

12. The invention of claim 11, wherein at least an attaching means secures said left side to said right side of said mounting arm.

13. The invention of claim 5, wherein said forked actuating lever straddling said mounting arm functions to maintain a first side and a second side of said mounting arm securely around a trigger guard.

14. A firearm coupling non-lethal chemical dispensing mechanism, comprising:

a housing unit having a removable cap with an aperture thereon, said housing unit and said cap removably enclosing a canister;

said canister having an actuating button and a nozzle communicating with said canister, wherefrom a chemical agent is discharged;

an actuating lever being in communication with said actuating button;

a mounting portion attaching to a firearm trigger guard, said mounting portion also attaching to said housing unit;

a binding portion receiving a firearm barrel; said binding portion attaching to said housing unit.

15. The invention of claim 14, wherein said actuating lever has at least a force pad located proximal to said fireguard.

16. The invention of claim 14, wherein said actuating lever is hingedly attached to said housing unit.

17. The invention of claim 16, wherein application of a reduced first force to said actuating lever produces a greater second force at an axis parallel to said canister and said actuating button, thereby facilitating discharge of said chemical agent.

18. The invention of claim 14, wherein said actuating lever is forked and has at least a first and a second force application pad.

19. The invention of claim 14, wherein said housing unit, said mounting portion, said binding portion are made of at least a first half and an opposing second half, when said first and said second half are joined, said binding portion encompasses said firearm barrel, said mounting portion encompasses said trigger guard, and said housing unit rotationally accommodating said actuating lever.

20. A removably mounted chemical dispensing housing unit which engages a firearm, comprising;

a first mounting portion and a second mounting portion, said mounting portions encompassing a firearm trigger guard;

a first housing unit connected to said first mounting portion, and a second housing unit connected to said second mounting portion, said housing units receiving a canister therein;

a first securing element connected to said first housing unit, and a second securing element connected to said second housing unit, said securing elements receiving a barrel of a firearm;

a cap with an aperture thereon attaching said first and second housing units, wherein said cap has an actuating ridge receiving an actuating button on said canister, and said canister having a nozzle received within said aperture of said cap, through which a chemical agent is discharged;

an actuating lever rotationally attaching to said first and second housing units, and said actuating lever having a contact ridge in communication with said canister;

at least a force application pad on said actuating lever at a point distal to a rotationally attaching point, where a reduced first force upon said application pad imparts a greater force upon said contact ridge and facilitates activation of said actuating button and dispensation of said chemical agent.

* * * * *